United States Patent [19]

Tominaga

[11] 4,395,604

[45] Jul. 26, 1983

[54] PULSE SWITCH

[75] Inventor: Shinobu Tominaga, Miyagi, Japan

[73] Assignee: Alps Electric Co., Ltd., Tokyo, Japan

[21] Appl. No.: 275,123

[22] Filed: Jun. 18, 1981

[30] Foreign Application Priority Data

Jun. 18, 1980 [JP] Japan ..... 55-85353[U]

[51] Int. Cl.[3] ..... H01H 19/24; H01H 5/16

[52] U.S. Cl. ..... 200/74

[58] Field of Search ..... 200/156, 154, 65, 66, 200/67 C, 67 G, 68, 70, 73, 74, 153 LB, 11 R, 11 G, 11 K

[56] References Cited

U.S. PATENT DOCUMENTS

| | | | |
|---|---|---|---|
| 2,708,227 | 5/1955 | Collura | 200/65 |
| 2,822,439 | 2/1958 | Schaefer et al. | 200/74 |
| 3,734,869 | 5/1973 | Menard et al. | 200/11 R |
| 3,876,848 | 4/1975 | Hartmann | 200/156 |
| 3,975,601 | 8/1976 | Whelan | 200/153 LB |
| 4,282,415 | 8/1981 | Shimizu et al. | 200/68 |

*Primary Examiner*—John W. Shepperd

*Attorney, Agent, or Firm*—Guy W. Shoup; Gerard F. Dunne

[57] ABSTRACT

A pulse switch capable of producing a large number of pulses for its reduced size. The pulse switch has a rotatable shaft, a gear having peripheral teeth and provided with a hub portion, the gear being adapted to rotate as a unit with the shaft, an operation member provided at its end with an integral cam portion for engagement with the valleys of teeth of the gear and disposed to loosely fit the hub portion of the gear, and a switch having a center resetting mechanism. The center resetting mechanism is adapted to take a neutral position when the operation member is in the initial position, and to bring a slide contact into engagement solely with respective stationary contacts as the shaft is rotated selectively either in the clockwise direction or counterclockwise direction.

10 Claims, 11 Drawing Figures

PULSE SWITCH

BACKGROUND OF THE INVENTION

The present invention relates to a pulse switch and, more particularly, to a pulse switch with a reduced size and capable of producing a comparatively large number of pulses while preserving a large stroke of the sliding motion of the sliding piece which makes a sliding contact with a stationary contact.

SUMMARY OF THE INVENTION

An object of the invention is to provide a pulse switch having a reduced size and capable of producing a comparatively large number of pulses.

Another object is to provide a pulse switch in which a large sliding stroke is preserved for a movable contact which makes a sliding contact with a stationary contact.

A switch is capable of producing a plurality of pulses during rotation of a operation rod of the switch. This switch comprises a toothed gear wheel connected to the shaft for rotation therewith. This gear wheel has a plurality of spaced teeth which define valley portions therebetween on the periphery of the gear wheel. An operation member is disposed over this gear wheel and is adapted to rotate independently of the gear. The operation member has a cam portion formed integrally therewith which is adapted to fit within the valley portions of the gear wheel. The operation member further carries a slidable contact having a contact portion on respective end portions of the operation member. One of these contact portions is adapted to engage a common stationary contact of the switch, and the other contact portion is movable between a first state out of engagement with at least one other stationary contact of the switch and a second state into engagement with the at least one other stationary contact of the switch upon rotation of the operation member. Means are provided for supporting the operation member for rotation about an axis near the one contact, and pulse means are connected with the operation member for normally holding it in one of the recited states and, upon rotation of said operation shaft, moving it between the two recited states each time the cam portion is moved into and out of engagement with respective valley portions.

The above and other objects, as well as advantageous features of the invention will become clear from the following description of the preferred embodiments taken in conjunction with the accompanying drawings.

DESCRIPTION OF THE PREFERRED EMBODIMENTS

Hereinafter, a preferred embodiment of the invention will be described with reference to the accompanying drawings.

Figure 1:
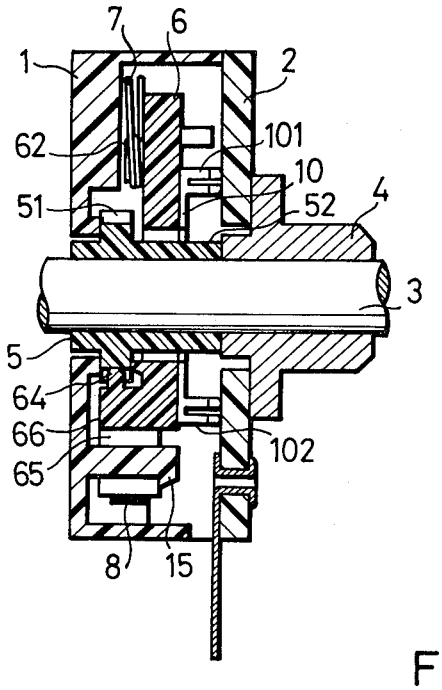
FIG. 1 is a sectional side elevational view of a pulse switch constructed in accordance with an embodiment of the invention.
Figure 2:
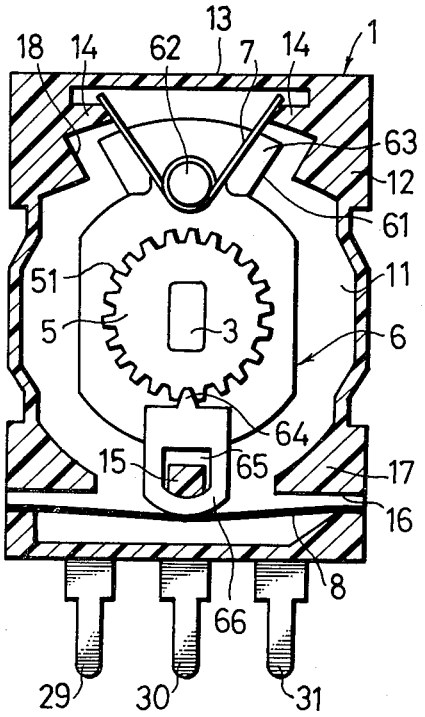
FIG. 2 is a sectional plan view of the pulse switch shown in FIG. 1.
Figure 3:
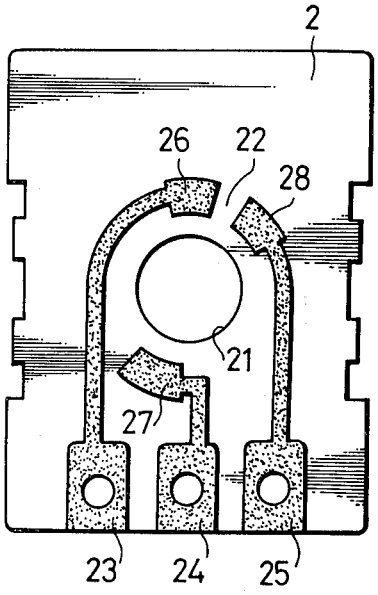
FIG. 3 is a plan view of an insulated substrate of the pulse switch shown in FIG. 1.

Referring first to FIGS. 1 and 2 which are a sectional side elevational view and a sectional plan view of a pulse switch in accordance with an embodiment of the invention, as well as to FIG. 3 which is a plan view of an insulated substrate, the pulse switch has a case 1 of a substantially box-like form constituted by a bottom panel 11, side walls 12 protruding upright on the lateral sides of the bottom panel 11, and a side plate 13. The case 1 is made of an electrically insulating material. A reference numeral 2 designates an insulated substrate attached to the opened top surface of the case 1. As will be seen from FIG. 3, a shaft bore 21 is formed substantially at the center of the insulated substrate 2. Reference numerals 23 through 28 denote conductors formed by printing a silver paste or the like material on the substrate. More specifically, numerals 23 to 25 are terminal electrodes, while numerals 26 and 28 designate a pair of change-over stationary contacts disposed to oppose each other across an insulating region 22. A common stationary contact 27 cooperates with the stationary contact 26 or 28 to constitute a pair of stationary contacts 26, 27 or 28, 27 as will be discussed below. A rotary shaft 3 is carried by a bearing 4 which is formed by, for example, die casting. A gear 5 fixed to the rotary shaft 3 is made of an electrically insulating material and is provided with a plurality of teeth 51 in its periphery. The gear 5 has a hub portion 52 which rotatably carries an operation member 6 shaped from an insulating material.

At an upper portion of the operation member 6, is a sector shaped stopper portion 61 having an upstanding projection 62 around which is wound a spring 7 having both ends acting upon opposing tabs 14 formed on the case 1. The spring 7 is held also by a pair of radial projections 63 extending upwardly from the stopper portion 61. A cam portion 66 formed at a lower portion of the operation member 6 has an upper end surface on which is formed a wedge-shaped protrusion 64 engaging with the teeth 51 of the gear 5. A bore 65 loosely receives a supporting shaft 15 projected upwardly from the bottom panel 11 of the case 1. A movable contact 10 made from a sheet of resilient metal plate has contact pieces 101, 102 and is fixed to the aforementioned operation member 6. A leaf spring 8 is supported in an engaging bore 16 formed in each of the opposing walls 12 of the case 1, and is adapted to resiliently act on the lower end surface of the cam portion 66 thereby to normally bias the operation member 6 upwardly.

As has been described, the operation member 6 is adapted to be held at a neutral position when the shaft 3 is not operated, by the action of the spring 7 wound around the upper end thereof and the leaf spring 8 acting on the lower end thereof. Terminals 29, 30 and 31 are fixed by caulking or the like measure to respective terminal electrodes 23 to 25.

The pulse switch of this embodiment having a construction described heretofore operates in a manner explained hereinunder with reference to FIGS. 4A to 4C and FIGS. 5A and 5B.

Figure 4A:
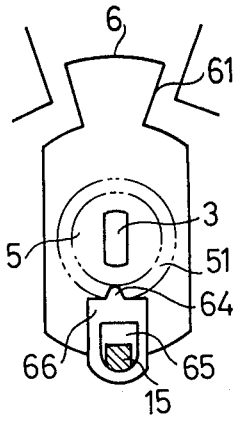
FIGS. 4A, 4B, 4C, 4A', 4B' and 4C', as well as FIGS. 5A and 5B are illustrations for explaining the operation of the pulse switch.
Figure 4B:
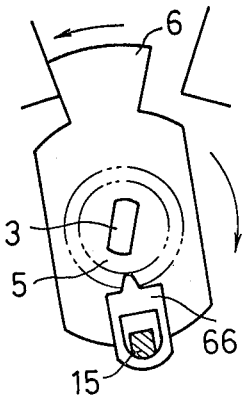
Figure 4C:
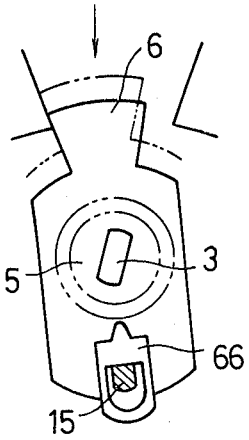
Figure 4C:
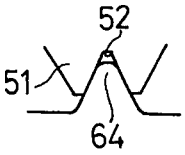
Figure 4C:
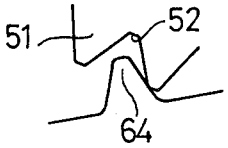
Figure 4C:
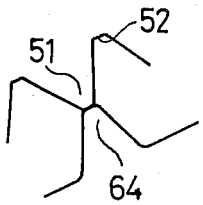

When the pulse switch takes the position shown in FIG. 4A, the shaft 3 has not been operated and the operation member 6 takes the neutral position. As will be understood from FIG. 4A', the protrusion 64 of the cam portion 66 is in engagement with a valley portion 52 between teeth 51 of the gear 5.

In this state, the contact piece 101 is positioned on the insulating region 22 between a pair of the change-over stationary contacts 26, 28, while the other contact 102 is positioned on the common stationary contact 27 so that the switch as a whole takes the off state.

As the shaft 3 is rotated clockwise from this position overcoming the force of the spring 7, the gear 5 is also rotated clockwise but the operation member 6 is rotated counter-clockwise because the tooth 51 of the gear 5 slidingly contacts the flank of the protrusion 64 of the cam portion 66. As a result, the contact piece 101 of the slide contact 101 caulked to the operation member 6 is moved toward the change-over contact 28, while the other contact piece 102 is moved counter-clockwise slightly on the common stationary contact 27. As the shaft 3 is further rotated from this state in the clockwise direction, the stopper portion 61 of the operation member 6 is contacted by the projection 18 of the case 1 to limit the rotation of the operation member 6. However, the tooth 51 of the gear 5 continues to slide on the flank of the protrusion 64 of the cam portion 66 to depress the cam portion 66 by overcoming the force of the leaf spring 8. At this time, the contact piece 101 stays in sliding contact with the change-over stationary contact 28 as shown in FIG. 5B as the crest of the tooth 51 comes into sliding contact with the crest of the protrusion 64. Meanwhile, the other contact piece 102 is slightly moved to the right on the common stationary contact 27. As the shaft 3 is rotated clockwise further from this state, the protrusion 64 is disengaged from the crest of the tooth 51, so that the operation member 6 is moved instantaneously by the force of the next spring 7, thereby to make the projection 64 of the cam portion 66 contact the next valley between the teeth 51 of the gear. In consequence, the operation member 6 is automatically reset to the neutral position after riding over one tooth of the gear 5 in the clock-wise direction. As a result, the contact pieces 101, 102 resume their starting or off positions so that one pulse signal is detected in the clockwise rotation of the shaft 3.

As the shaft 3 is continuously rotated in the clockwise direction, the above-described operation is repeated to make the protrusion 64 of the cam portion 66 to engage and disengage with successive teeth 51 of the gear 5, so that the pulses of a number corresponding to the number of teeth 51 engaged and disengaged by the projection 64 are produced during rotation of the shaft 3. Also as the shaft 3 is rotated in the counter-clockwise direction, the pulses are produced in a similar manner.

Figure 5A:
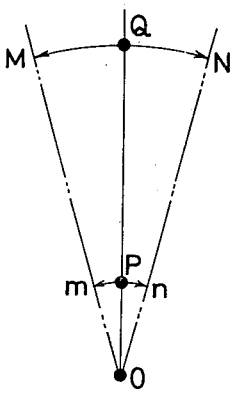
Figure 5B:
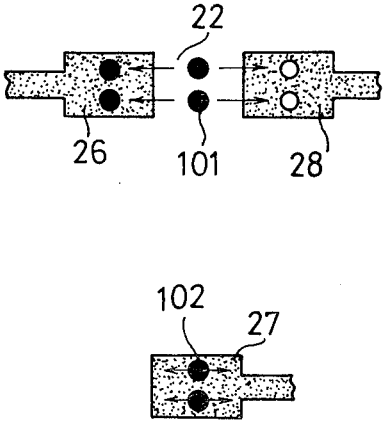

During the operation of the pulse switch of this embodiment, the operation member 6 makes a pendulum action around the fulcrum O presented by the supporting shaft received by the bore 65 in the cam portion 66 and shown diagrammatically in FIG. 5(A). Accordingly, it is possible to obtain a large stroke M–N of movement at the end portion of the operation member 6 for a comparatively small displacement m–n of the portion P corresponding to the projection 64 on the cam portion 66. It is, therefore, possible to obtain a comparatively large stroke of sliding of the contact piece 101 while maintaining a comparatively small stroke of sliding movement of the other contact piece 102, by disposing the slide contact piece 101 for contacting the change-over stationary contacts 26, 28 at the end portion O while disposing the other slide contact piece 102 for contacting the common stationary contact 27 at the position P corresponding to the projection 64. This arrangement offers various advantages. Firstly, it becomes easy to arrange the stationary contact formed on the substrate 2. Secondly, the stability of the switching operation of the switch is very much increased. Thirdly, the number of teeth of the gear can be increased. In consequence, according to the invention, it is possible to obtain a pulse switch which can produce a comparatively large number of pulses per angle of rotation in spite of a reduced size of the pulse switch as a whole.

The engagement and disengagement of the protrusion 64 with and from the teeth 51 of the gear 5 are achieved in quite a stable manner thanks to the provision of the leaf spring which also imparts a feel of detent operation to the operator. In addition, the number of parts is reduced advantageously by an integral formation of the cam portion 66 with the operator 6 and by making the protrusion 64 play also the role of a support for the sliding contact 10.

Needless to say, the pulse switch of the invention can be used as a single unit or may be incorporated in a rotary variable resistor of a known type.

Other changes and modifications are possible without departing from the scope of the invention which is limited solely by the appended claims.

What is claimed is:

1. A switch capable of producing a plurality of pulses during rotation of an operation shaft of said switch, comprising:

a toothed gear wheel connected to said shaft for rotation therewith and having a plurality of spaced teeth defining valley portions therebetween on the periphery of said gear;

an operation member disposed over said gear and adapted to rotate independently of said gear, said operation member having a cam portion formed integrally therewith and adapted to fit within said valley portions, said operation member further carrying a slidable contact having a contact portion on respective end portions of said operation member with one of said contact portions adapted to engage a common stationary contact of said switch and the other of said contact portions being movable between a first state out of engagement with at least one other stationary contact of said switch and a second state into engagement with said at least on other stationary contact upon rotation of said operation member;

means for supporting said operation member for rotation about an axis near said one contact; and pulse means connected with said operation member for normally holding it in one of said states and, upon rotation of said operation shaft, moving it between said two states each time said cam portion is moved into and out of engagement with respective valley portions.

2. A switch according to claim 1, said at least one other stationary contact being constituted by two contact elements positioned on opposite sides of the other of said contact portions whereby the other of said contact portions may be moved into engagement with either of said two contact elements depending on the direction of rotation of said operation shaft.

3. A switch according to claim 1, said pulse means including a resilient element engaging said cam portion and urging it into the valley portions of said gear wheel but allowing said cam portion to be moved away from said gear wheel by the teeth thereof as said gear wheel is rotated.

4. A switch according to claim 3, said resilient element being a leaf spring having its central portion bearing against said cam portion and its end portions held by opposite side walls of the casing of said switch.

5. A switch according to claim 4, said at least one other stationary contact being constituted by two contact elements positioned on opposite sides of the other of said contact portions whereby the other of said contact portions may be moved into engagement with either of said two contact elements depending on the direction of rotation of said operation shaft.

6. A switch according to claim 3, said at least one other stationary contact being constituted by two contact elements positioned on opposite sides of the other of said contact portions whereby the other of said contact portions may be moved into engagement with either of said two contact elements depending on the direction of rotation of said operation shaft.

7. A switch according to claim 1, said pulse means including a resilient member connected to said operation member elements positioned on opposite sides of the other of said contact portions whereby the other of said contact portions may be moved into engagement with either of said two contact elements depending on the direction of rotation of said operation shaft.

8. A switch according to claim 7, said resilient member being a coil spring having a coil portion fitted around a projection upstanding from said operation member and respective end portions bearing against opposite side wall portions of the casing of said switch.

9. A switch according to claim 8, said at least one other stationary contact being constituted by two contact elements positioned on opposite sides of the other of said contact portions whereby the other of said contact portions may be moved into engagement with either of said two contact elements depending on the direction of rotation of said operation shaft.

10. A switch according to claim 7, said at least one other stationary contact being constituted by two contact and engaging the side walls of the casing of said switch for urging said operation member into its first state.

* * * * *